US006393241B1

(12) United States Patent
Matsumoto et al.

(10) Patent No.: US 6,393,241 B1
(45) Date of Patent: May 21, 2002

(54) NOZZLE HAVING AN END PORTION CAPABLE OF PENETRATING INTO A TONER DISCHARGING PORTION INCLUDED IN A TONER CONTAINER THAT STORES POWDERY TONER

(75) Inventors: Junichi Matsumoto; Nobuo Kasahara; Satoshi Muramatsu; Nobuo Iwata, all of Kanagawa; Takaaki Yanagisawa, Tokyo; Tomotoshi Nakahara, Kanagawa; Masumi Sato, Kanagawa; Yoshio Hattori, Kanagawa; Kouta Fujimori, Kanagawa; Kazuhisa Sudo, Kanagawa, all of (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/672,962

(22) Filed: Sep. 29, 2000

(30) Foreign Application Priority Data

Sep. 30, 1999 (JP) ..... 11-280032
Sep. 8, 2000 (JP) ..... 2000-273153

(51) Int. Cl.[7] ..... G03G 15/08
(52) U.S. Cl. ..... 399/258; 399/260; 399/262
(58) Field of Search ..... 399/258, 260, 399/262, 119, 102, 103, 105, 106

(56) References Cited

U.S. PATENT DOCUMENTS 5,937,235 A * 8/1999 Huss et al. ..... 399/102
5,960,246 A 9/1999 Kasahara et al.
5,983,059 A * 11/1999 Oka et al. ..... 399/262
6,304,739 B1 * 10/2001 Katsuyama et al. ..... 399/262

FOREIGN PATENT DOCUMENTS

DE 6630628 A1 * 7/1995
JP 2677575 7/1997
JP 2000-081778 3/2000
JP 20-227706 A * 8/2000
JP 20-356898 A * 12/2000
JP 2001175083 A * 6/2001

* cited by examiner

*Primary Examiner*—Quana M. Grainger
(74) *Attorney, Agent, or Firm*—Oblon, Spivak, McClelland, Maier & Neustadt, P.C.

(57) ABSTRACT

A toner conveying device for an image forming apparatus includes a nozzle capable of penetrating into a toner container when the toner container is mounted to the image forming apparatus. The nozzle has a tubular structure forming an air passage for sending air into the toner container and a toner passage for delivering toner discharged from the toner container. Air sent into the toner container via the air passage fluidizes toner existing in the toner container, so that the toner can be surely replenished to a developing unit.

53 Claims, 13 Drawing Sheets

NOZZLE HAVING AN END PORTION CAPABLE OF PENETRATING INTO A TONER DISCHARGING PORTION INCLUDED IN A TONER CONTAINER THAT STORES POWDERY TONER

BACKGROUND OF THE INVENTION

The present invention relates to a copier, facsimile apparatus, printer or similar electrophotographic image forming apparatus and more particularly to a nozzle capable of penetrating into a toner container and a toner conveying device including the same.

A toner container for use with an electrophotographic image forming apparatus has customarily been implemented as a cartridge, bottle or similar hard case. A hard toner container, however, brings about a critical problem as to collection after use. Specifically, when the toner container is emptied, it is collected from the user's station by a manufacturer and then recycled, reused or incinerated. In this respect, the conventional toner container having a substantial volume increases the distribution cost.

In light of the above, a toner container whose volume is reducible has been proposed. Such a toner container, however, prevents a toner replenishing device from stably replenishing toner from the toner container to a developing device. Further, even if the volume of the toner container is reducible only during transport, toner smears surroundings when transferred from the container.

The toner replenishing device and toner container must be formed integrally with or located extremely close to each other because conventional toner conveying technologies rely on mechanical auger means. This arrangement makes the structure of the toner replenishing device sophisticated, increases the cost, lowers productivity, and obstructs maintenance. Further, it is difficult to protect the property of toner from deterioration. In addition, manual replacement of the toner container is troublesome.

On the other hand, there has been proposed a toner conveying device of the type fluidizing toner existing in atoner container with compressed air to thereby discharge the toner and conveying the toner to a developing unit with a stream of air or a powder pump. This type of toner conveying device allows the toner container to be positioned at any desired position without regard to the position of the developing unit. Moreover, the device frees the toner from mechanical stresses.

However, even the above-described type of toner conveying device has some problems left unsolved. For example, if the toner present in the toner container around the mouth of the container, particularly above the mouth, is not sufficiently fluidized, then stable toner replenishment is apt to fail. Also, if the amount of fluidized toner is short, then much toner is left in the toner container without being discharged.

Generally, toner is conveyed via a nozzle capable of penetrating into a toner container. The toner container is therefore provided with slit sealing means formed of, e.g., sponge and capable of being opened by the nozzle. This, however, brings about a problem that the nozzle is apt to tear off the sealing means when moving into and out of the toner container.

Technologies relating to the present invention are disclosed in, e.g., Japanese Patent Laid-Open Publication No. 2000-81778 and Japanese Patent No. 2,677,575.

SUMMARY OF THE INVENTION

It is therefore an object of the present invention to provide a nozzle capable of surely conveying toner from a toner container to thereby allow a minimum of toner to remain in the container and reducing the tearing of sealing means fitted in the container, and a toner conveying device including the same.

In accordance with the present invention, a nozzle having an end portion capable of penetrating into a toner discharging portion included in a toner container that stores powdery toner includes a tubular nozzle body, an air passage formed in the nozzle body for sending air into the toner container, and a toner passage also formed in the nozzle body for delivering the toner discharged from the toner container. The air passage and toner passage may be implemented by a single passage formed in the nozzle body.

Also, in accordance with the present invention, in a toner conveying device including a nozzle having an end portion capable of penetrating into a toner discharging portion included in a toner container that stores powdery toner, the nozzle includes a tubular nozzle body, an air passage formed in the nozzle body for sending air into the toner container, and a toner passage also formed in the nozzle body for delivering the toner discharged from the toner storing means.

Further, in accordance with the present invention, in an image forming apparatus including a toner conveying device including a nozzle having an end portion capable of penetrating into a toner discharging portion included in a toner container that stores powdery toner includes a tubular nozzle body, an air passage formed in the nozzle body for sending air into the toner container, and a toner passage also formed in the nozzle body for delivering the toner discharged from the toner storing means.

Moreover, in accordance with the present invention, in an image forming apparatus including a nozzle having an end portion capable of penetrating into a toner discharging portion included in a toner container that stores powdery toner includes a tubular nozzle body, an air passage formed in the nozzle body for sending air into the toner container, and a toner passage also formed in the nozzle body for delivering the toner discharged from the toner container.

In addition, in accordance with the present invention, in an image forming apparatus capable of conveying toner stored in a toner container to a developing unit with a toner conveying device for thereby replenishing the toner, the end portion of a nozzle being capable of penetrating into a toner discharging portion included in the toner container, the nozzle includes a tubular nozzle body, an air passage formed in the nozzle body for sending air into the toner container, and a toner passage also formed in the nozzle body for delivering the toner discharged from the toner container.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
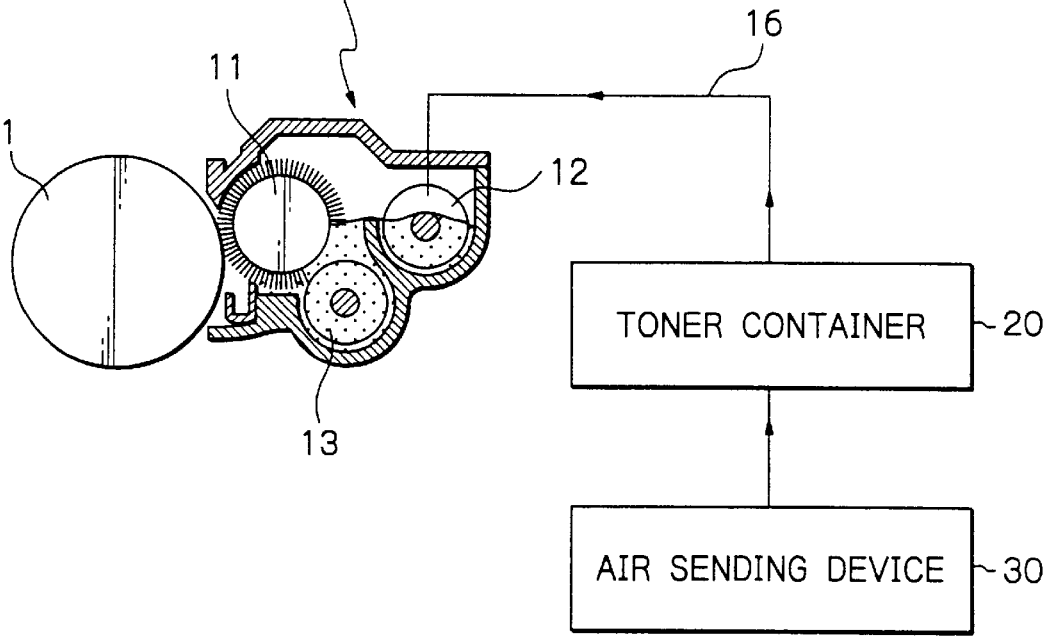
FIG. 1 is a view showing a toner replenishing device included in an image forming apparatus embodying the present invention.
Figure 2:
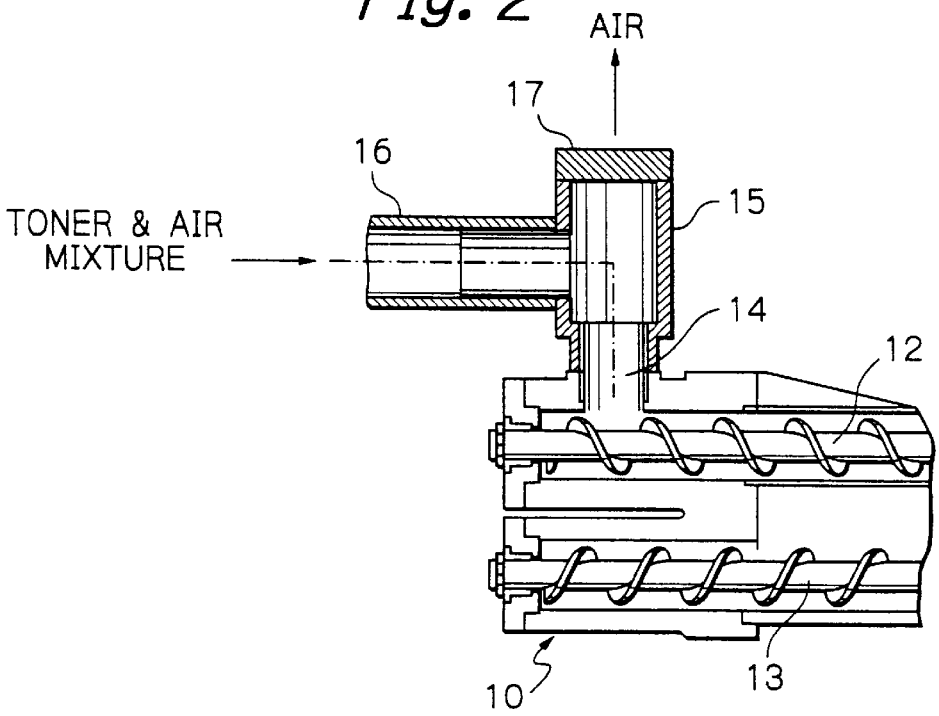
FIG. 2 is a section showing a toner receiving portion included in a developing unit to which the toner replenishing device replenishes toner.

Referring to FIG. 1 of the drawings, a toner replenishing system in accordance with the present invention and applicable to an image forming apparatus is shown. FIG. 2 shows part of a developing unit to which the toner replenishing device replenishes toner. As shown in FIG. 1, the toner replenishing system replenishes toner to a developing unit 10 and includes a toner container 20 and a toner conveying device embodying the present invention 16. The toner container or toner storing means 10 stores fresh toner therein. The toner conveying device 16 exerts a conveying force on the toner existing in the toner container 20 so as to convey it to the developing unit 10. The toner replenishing system additionally includes an air sending device 30.

As shown in FIGS. 1 and 2, the developing unit 10 includes a developing sleeve 11 facing a photoconductive element or image carrier implemented as a drum 1 and a first and a second screw 12 and 13, respectively. The developing unit 10 stores a developer consisting of toner particles and carrier particles. The first screw 12 conveys the developer from the left to the right, as viewed in FIG. 2, while the second screw 13 conveys it from the right to the left. As a result, the developer is circulated in the developing unit 10. During circulation, the developer deposits on the developing sleeve 11 and then develops a latent image electrostatically formed on the drum 1.

As shown in FIG. 2, a toner inlet 14 is formed in the developing unit 10 and faces the first screw 12 at the front end of the unit 10. A connecting member 15 is fitted on the developing unit 10 and communicated to the toner inlet 14. A tube or conveying member 16 is removably connected to the connecting member 15. An air filter 17 forms part of the connecting member 15 and discharges only air contained in a toner and air mixture therethrough. This prevents the toner from flying out of the connecting member 15 or the developing unit 10 at the time of replenishment. It is to be noted that the toner replenishing position shown in FIG. 2 is only illustrative, and that the developing unit 10 may have any other suitable configuration.

The toner container 20 is implemented as a unit independent of he developing unit 10 and mounted to a suitable position on the apparatus body. The tube 16 communicates the toner container 20 to the developing unit 10. The tube 16 is a flexible tube having a diameter of, e.g., 4 mm to 10 mm. For the tube 16, use should preferably be made of rubber highly resistant to toner, e.g., polyurethane rubber, nitrile rubber, EPDM rubber or silicone rubber. A flexible tube is advantageous in that it can be easily arranged in any desired direction, i.e., upward, downward, rightward or leftward.

Figure 3:
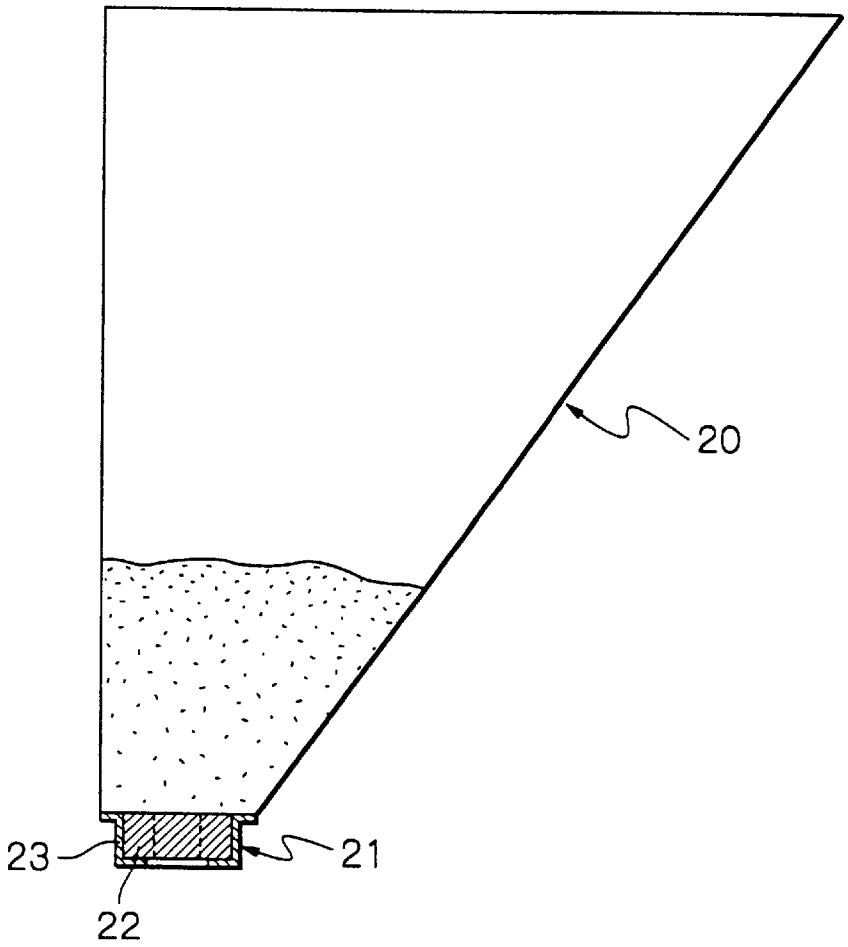
FIG. 3 is a section showing a toner container embodying the present invention.
Figure 4:
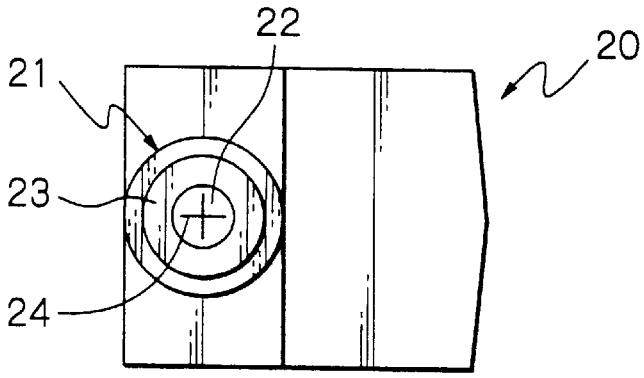
FIG. 4 is a bottom view of the toner container shown in FIG. 3.

FIGS. 3 and 4 show a specific configuration of the toner container 20. As shown, the toner container 20 is a trapezoidal, hexahedral bag or box whose front wall and rear wall sequentially decrease in width toward the bottom. The toner container 20 is hermetic and formed of polyethylene, nylon or similar resin or paper. A seal valve or sealing means 21 is fitted in the bottom of the toner container 20 and formed of an elastic material, preferably foam sponge. The seal valve 21 is made up of a disk-like seal member 22 and an affixing member 23 affixing the seal member 22 to the toner container 20. As shown in FIG. 4, the seal member 22 is formed of cruciform slits 24 intersecting each other at the center of the seal member 22.

The toner container 20 may be implemented as a hard case made up of a toner storing portion and a mouth portion and produced by, e.g., blow molding. In the illustrative embodiment, the toner container 20 is constituted by a flexible sheet of resin or paper, which is 80 $\mu$m to 200 $\mu$m thick or so, or a laminate of such sheets. Aluminum may be deposited on the front or the rear of each sheet for coping with static electricity and moisture.

The flexible toner container 20 having the above-described configuration is easier to handle at the time of transport or storage than a hard case and needs a minimum space for storage. When the toner container 20 is emptied, a manufacturer collects it for reuse, recycling or incineration. In such a case, the flexible, bag-like configuration of the toner container 20 allows the container 20 to be folded up and further promotes easy transport while further reducing the space requirement. This successfully reduces the cost of collection from the user's station to the manufacturer to a significant degree. The toner container 20 and seal valve 21 should preferably be formed of the same materials or similar materials in order to make separation needless at the time of recycling.

Figure 5:
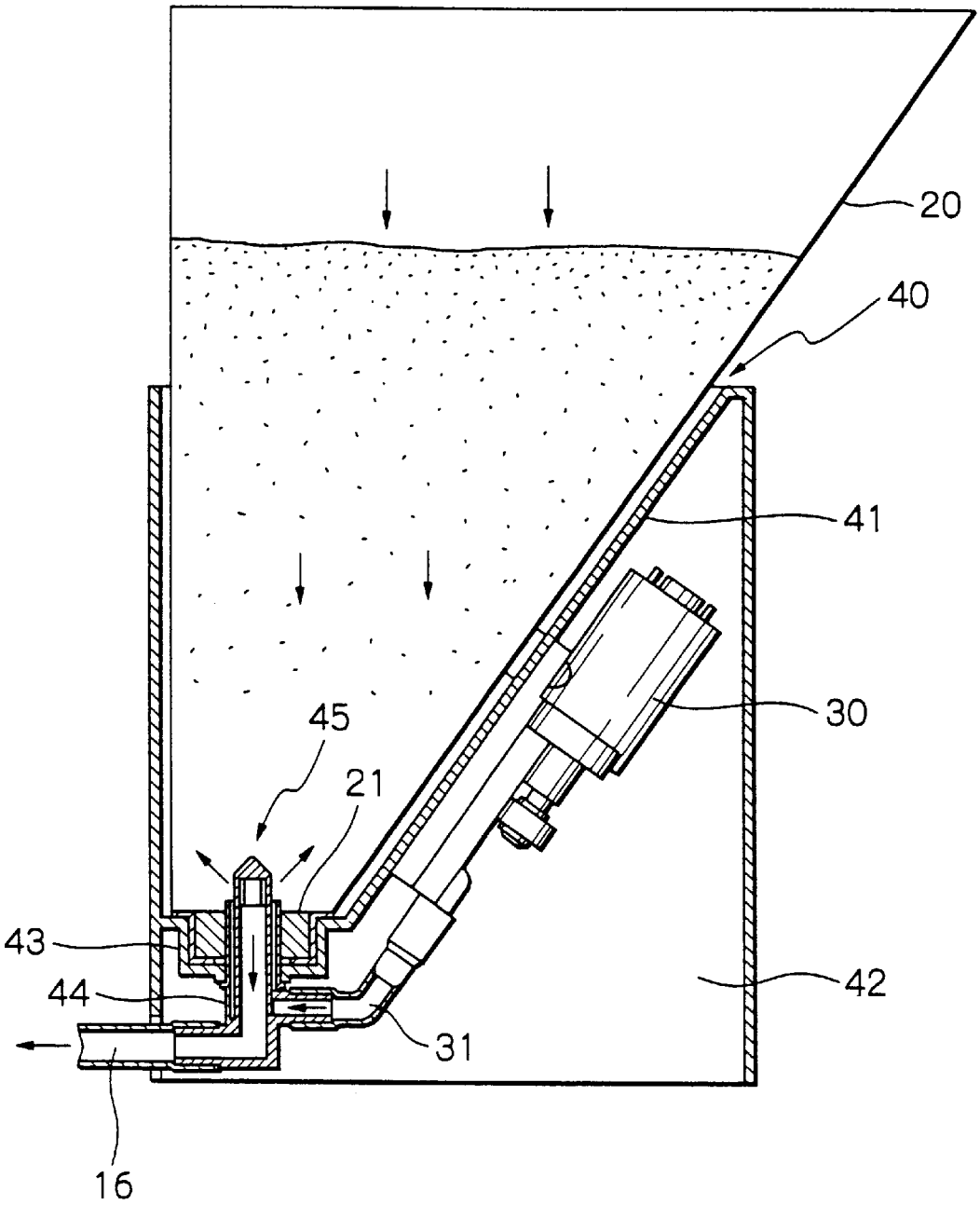
FIG. 5 is a section showing a specific condition wherein the toner container is set.

FIG. 5 shows the toner container 20 mounted to the apparatus body. As shown, the apparatus body includes a setting portion 40 in which the toner container 20 is set in the position shown in FIG. 3. The setting portion 40 may be located at any suitable position, e.g., a position accessible when a door or a cover mounted on the apparatus body is opened or a position on the outside of the apparatus body. The setting portion 40 includes a top-open support frame 41 configured complementarily to the toner container in order to support the container 20. A framework 42 included in the apparatus body supports the support frame 41. A recess 43 is formed in the bottom of the setting port ion 40 for receiving the seal valve 21. A nozzle 45 in accordance with the present invention extends upward from the bottom of the recess 43.

Figure 6:
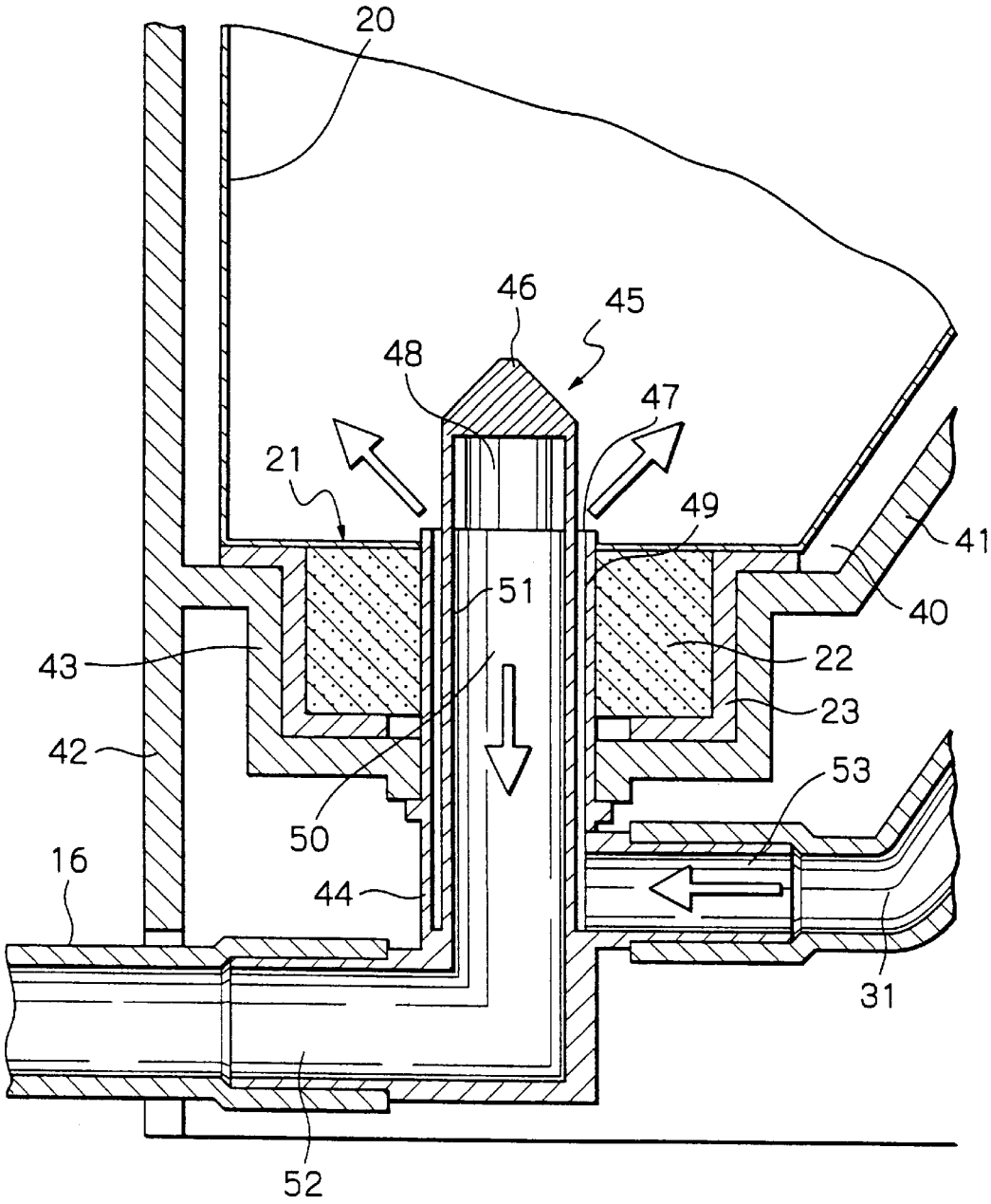
FIG. 6 is an enlarged section showing essential part of the condition of FIG. 5.

As shown in FIG. 6, the nozzle 45 includes a hollow cylindrical body 44 and a conical tip 46 constituting the top of the body 44. An air outlet 47 and a toner inlet 48 are formed in the end portion of the body 44, which faces the tip 46, at substantially the same level or height. The body 44 has a tubular double-wall structure including an air passage 49 and a toner passage 50 that are isolated from each other by a partition 51. The air passage 49 and toner passage 50 are communicated to the air outlet 47 and toner inlet 48, respectively. The toner passage 50 extends downward to the bottom of the body 44 and then bends to the left, as viewed in FIG. 6, to terminate at a toner outlet 52. The previously mentioned tube 16 is fitted on the wall of the toner outlet 52. The air passage 49 bends to the right, as viewed in FIG. 6, at a higher level than the toner passage 50 and terminates at an air inlet 53. An air pipe 31 extending from the air sending device 30, FIG. 1, is fitted on the wall of the air inlet 53. In the illustrative embodiment, the air sending device 30 is implemented by an air pump.

Figure 7:
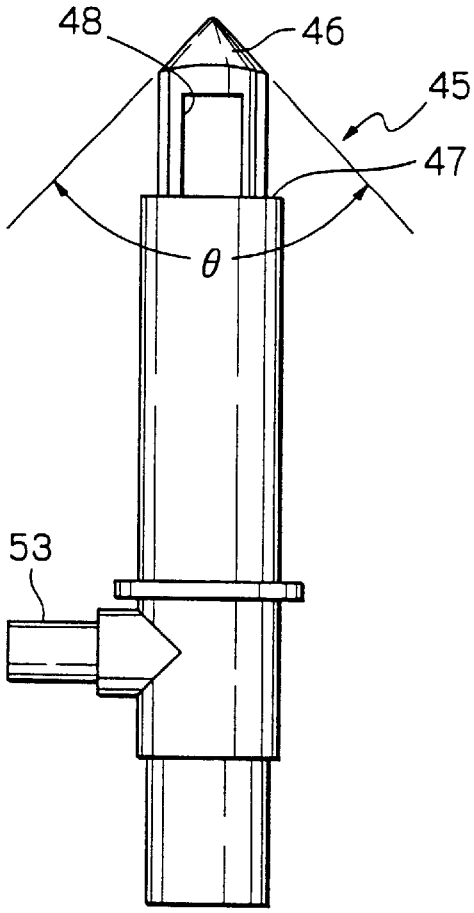
FIG. 7 is a front view showing a specific configuration of a nozzle included in the toner replenishing device.

When the operator sets the toner container 20 in the setting portion 40, the nozzle 45 penetrates an elastic seal member 22 included in the seal valve 21 by forcing the slits 24 to open. As a result, the end portion of the nozzle 45 smoothly enters the toner container 20 because the seal member 22 is elastic and because the tip 46 is conical. As shown in FIG. 7, to facilitate the entry of the nozzle 45 into the toner container 20, the conical tip 46 should preferably have an acute angle θ of 90° or less. If the top of the tip 46 is sharply pointed, it is likely to damage the sponge of the seal valve 21 when the toner container 20 is displaced from a preselected position. In light of this, the top of the tip 46 should preferably be rounded. When the operator pulls the toner container 20 out of the setting portion 40, the slits 24 of the seal valve 21 elastically restore their original position and again hermetically seal the container 20 despite that the nozzle 45 comes out of the container 20. This causes a minimum amount of toner existing in the toner container 20 to fly about via the slits 24.

Figure 8:
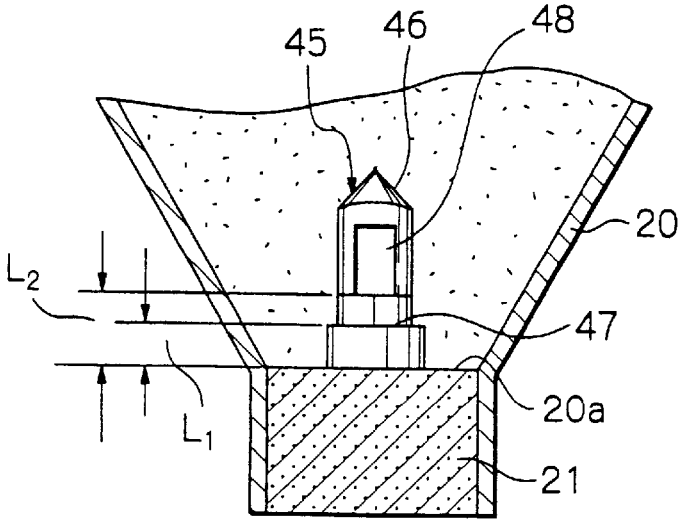
FIG. 8 is a view showing another specific condition wherein the toner container is set.

As shown in FIG. 8, when the toner container 20 is fully positioned in the setting portion 40, the air outlet 47 and toner inlet 48 are positioned above the bottom 20*a* of the container 20. Assume that the distance between the bottom 20*a* of the toner container 20 and the lowermost portion of the air outlet 47 is L1, and that the distance between the bottom 20*a* and the toner inlet 48 is L2. Then, the distances L1 and L2 each have a preselected value. Specifically, the distances L1 and L2 are selected to be 3 mm or above, but 10 mm or below. The distances L1 and L2 of 3 mm or above surely prevent the seal valve 21 from stopping the mouth of the toner container 20 even when the seal valve 21 turns up. Also, the distances L1 and L2 of 10 mm or below allows air to sufficiently agitate the toner existing in the toner container 20 and reduces the amount of toner to remain in the container 20.

As stated above, only if the operator puts the toner container 20 in the setting portion 4Q, the nozzle 45 automatically opens the seal valve 21 and enters the container 20 up to a preselected position. By such a simple operation, the toner container 20 is fully set on the apparatus body.

In response to a replenishment command, the air pump 30 starts sending compressed air into the toner container 20 via the air passage 49 and air outlet 47. The resulting air stream flows through the toner in the toner container 20 while scattering and fluidizing it until air fills the container 20. Because the toner container 20 is substantially hermetic, air pressure inside the container 20 sequentially rises. As a result, the toner moves downward due to air discharge pressure and its own weight. The toner is therefore replenished to the developing unit 10 via the toner inlet 48, toner passage 50, and tube 16.

As stated above, the toner is conveyed from the toner container 20 to the developing unit 10 by air pressure. At this instant, air flowing into the toner container 20 fluidizes the toner and thereby insures the smooth and sure conveyance of the toner based on air pressure. Further, the toner container 20 extends toward the nozzle 45 in a funnel configuration, the toner remains little in the container 20. Moreover, because the bag-like toner container 20 is constantly filled with air, the container 20 is free from folds and creases despite that it is implemented by a sheet or film. This reduces the frictional resistance of the inner wall of the toner container 20. Although air is conveyed to the developing unit 10 together with the toner, it flows out via the air filter 17 and prevents the toner from flying about in the developing section.

The toner conveyance using air pressure exerts no mechanical stresses on the toner and fluidizes the toner with air, thereby obviating the cohesion and bridging of the toner. Further, the toner stably flows out of the toner container 2 with a staple property and remains in the toner container 20 little without regard to its amount existing in the container 20.

Figure 9:
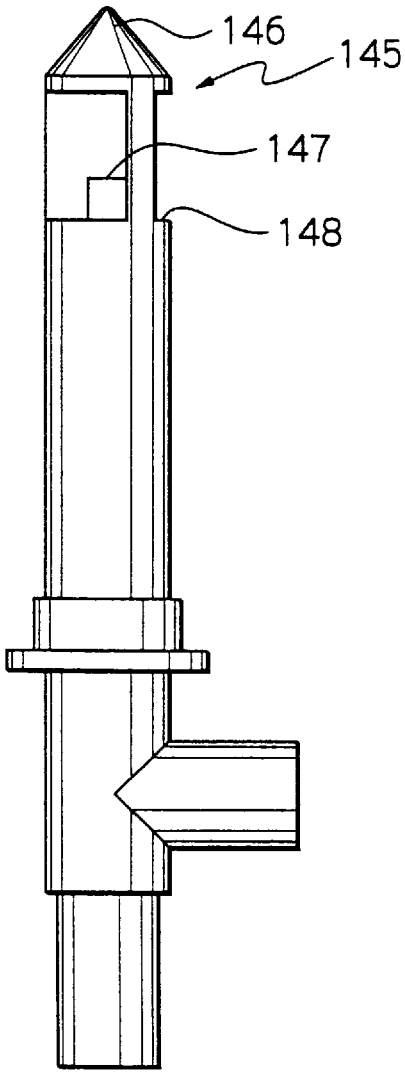
FIG. 9 is a front view showing another specific configuration of the nozzle.
Figure 10:
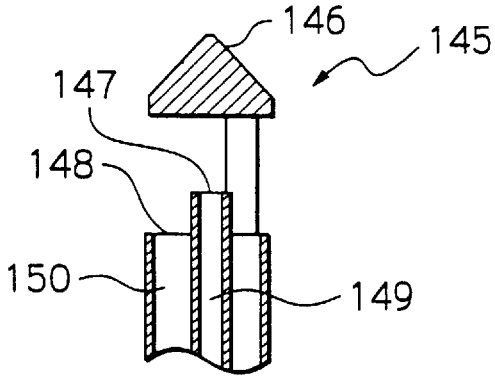
FIG. 10 is a section of the nozzle shown in FIG. 9.

Another specific configuration of the nozzle will be described with reference to FIGS. 9 and 10. As shown, a nozzle, labeled 145, also has a tubular double-wall structure. The nozzle 145 differs from the nozzle 45 in the following respects. A toner passage 150 surrounds an air passage 149. The nozzle 145 has an umbrella-like tip 146. As shown in FIG. 10, air flowing upward via the nozzle 145 hits against the bottom of the tip 146 and then flows in substantially the horizontal direction. Air therefore spreads over a broad range. As for the configuration of the toner container 20 shown in FIG. 3, less air reaches the inclined wall of the toner container 20 than the vertical walls of the same; if the angle of the inclined wall is small, it is more difficult for the toner to drop due to its own weight. The nozzle 145 allows air to flow over a broad range and thereby fluidizes even the toner on the inclined wall of the toner container 2, further reducing the amount of toner to remain in the container 2.

Figure 11:
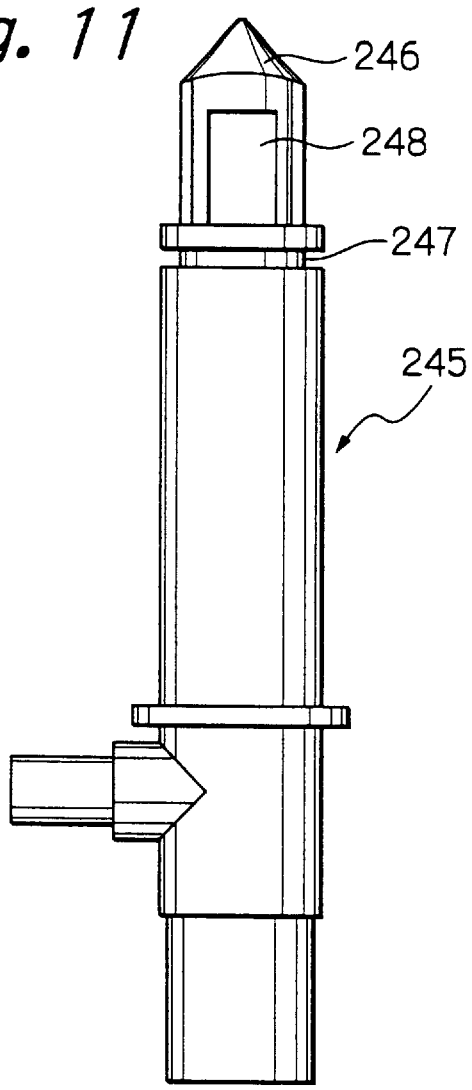
FIG. 11 is a front view showing another specific configuration of the nozzle.
Figure 12:
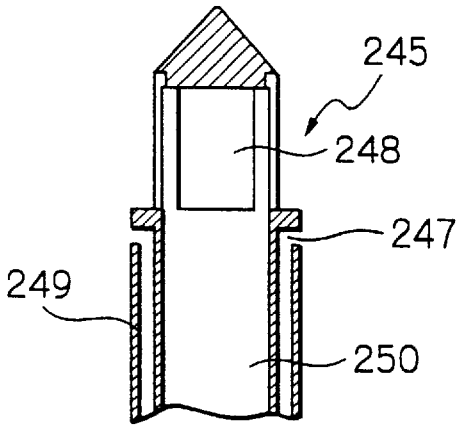
FIG. 12 is a section of the nozzle shown in FIG. 11.

FIGS. 11 and 12 show another specific configuration of the nozzle. As shown, the nozzle, labeled 245, is identical with the nozzle 45 of FIG. 6 in that an air passage 249 surrounds a toner passage 250. The nozzle 245 is formed with an air outlet 247 in its sidewall. The air outlet 247 is implemented as a 1 mm to 3 mm wide slit. As shown in FIG. 12, air flows out via the air outlet 247 in substantially the horizontal direction, i. e., not only upward but also sideways over a broad range. This is also successful to fluidize even the toner on the inclined wall of the toner container 20 and therefore to reduce the amount of toner to remain in the container 20.

Figure 13:
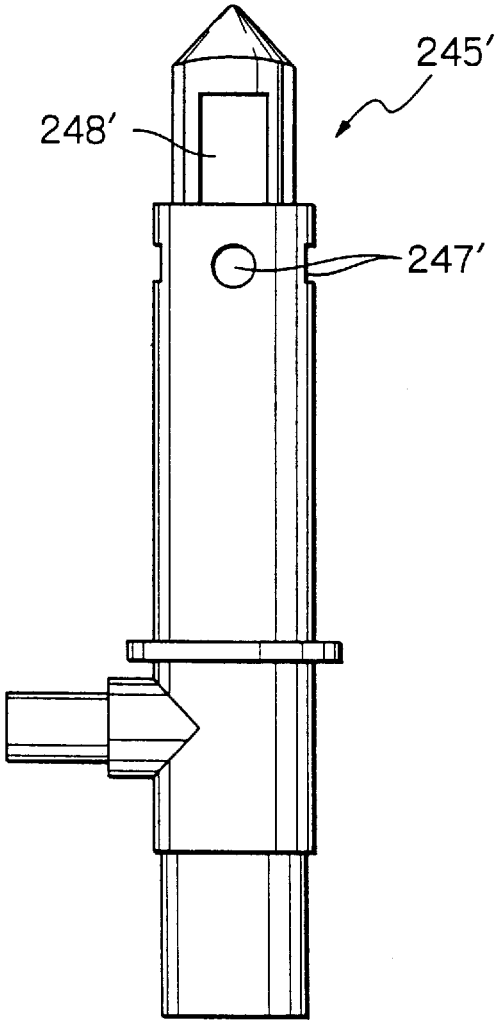
FIG. 13 is a front view showing a modification of the nozzle of FIG. 11.
Figure 14:
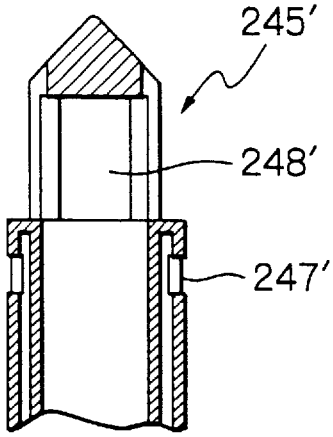
FIG. 14 is a section of the nozzle shown in FIG. 13.

FIGS. 13 and 14 show a modification of the nozzle 245 shown in FIGS. 11 and 12. As shown, the nozzle, labeled 245', is formed with air outlets or holes 247' in its side wall. The nozzle 245', like the nozzle 245, allows air to flow out via the air outlets 247' in the horizontal direction and therefore over a broad range.

Figure 15:
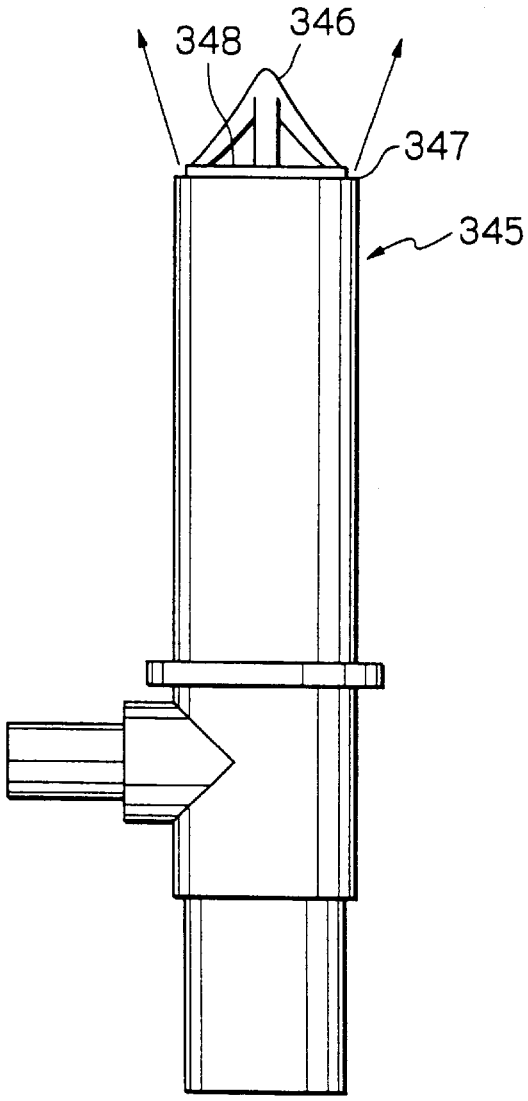
FIG. 15 is a front view showing another specific configuration of the nozzle.
Figure 16:
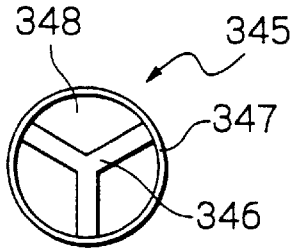
FIG. 16 is a section of the nozzle shown in FIG. 15.

FIGS. 15 and 16 show another specific configuration of the nozzle. As shown, the nozzle, labeled 345, is identical with the nozzle 45 of FIG. 6 in that an air passage surrounds a toner passage. The nozzle 345 is formed with an upwardly open toner inlet 348 at its end. A tip 346, resembling the ribs of an umbrella, is provided on the end of the nozzle 345 where the toner inlet 348 is open. With this configuration, the nozzle 345 can easily penetrate into the toner container 20. Further, air sent into the toner container 20 flows along the side of the toner inlet 348, easily fluidizing and discharging the toner around the toner inlet 348. In addition, when the toner container 20 is pulled out, the toner in the nozzle 345 drops from the nozzle 345 without staying in the toner container 20.

Figure 17:
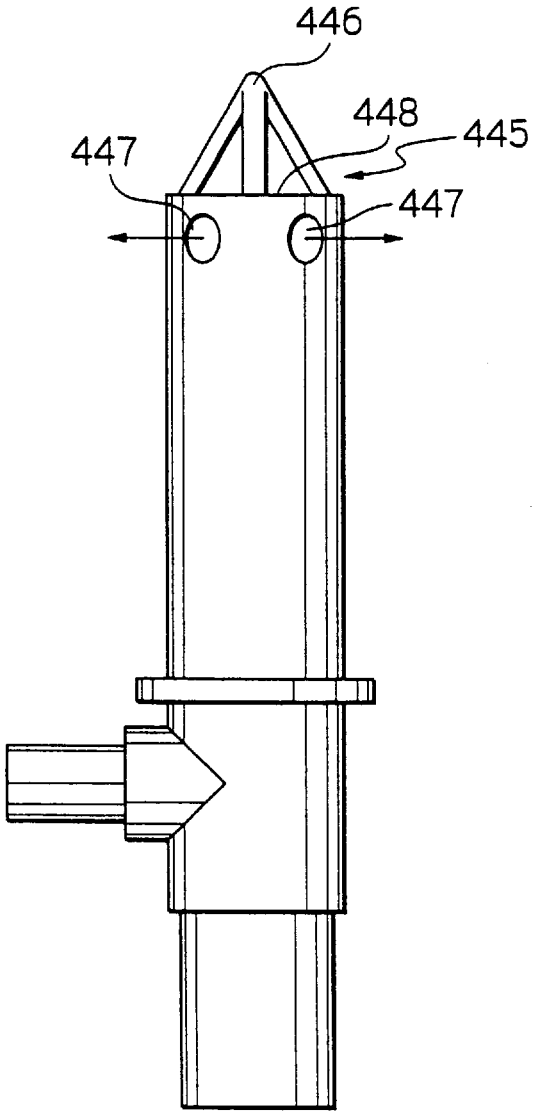
FIG. 17 is a front view showing another specific configuration of the nozzle.
Figure 18:
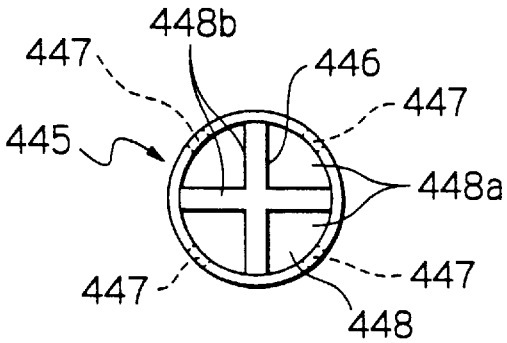
FIG. 18 is a section of the nozzle shown in FIG. 17.

Another specific configuration of the nozzle will be described with reference to FIGS. 17 and 18. As shown, the nozzle, labeled 445, has an air passage surrounding a toner passage like the nozzle 45 of FIG. 6. Also, the nozzle 445 has an upwardly open toner inlet 448 like the nozzle 345 of FIGS. 15 and 16. A tip 446 is provided on the end of the nozzle 445 where the toner inlet 448 is open, and has four ribs. As shown in FIG. 18, the tip 446 has a cruciform configuration, as seen from the above. The toner in let 446 is therefore defined by cruciform rib portions 448*b* and open portions 448*a* alternating with each other. Four air outlets or holes 447 are formed in the side wall of the nozzle 445, and each aligns with one of the open portions 448*a* in the axial direction of the nozzle 445. Because the air outlets 447 are aligned with the open portions 448*a*, air agitates and sufficiently fluidizes the toner around the open portions 448*a*, among others. This part of the toner can therefore easily enter the nozzle 445 and insures a preselected amount of replenishment.

Figure 19:
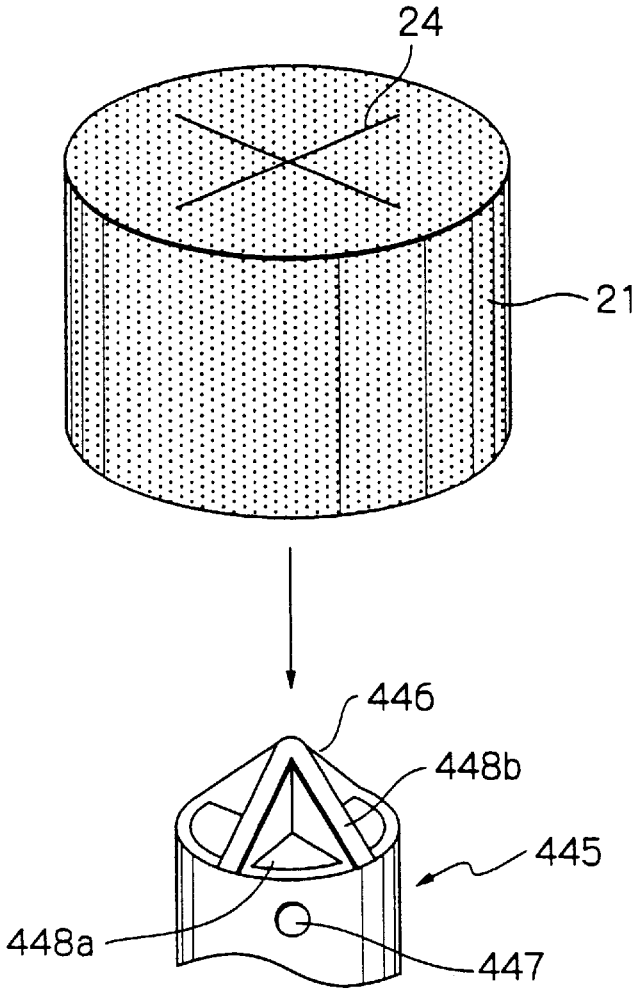
FIG. 19 is an isometric view showing a positional relation between the nozzle of FIG. 17 and slits formed in a seal valve in accordance with the present invention.
Figure 20:
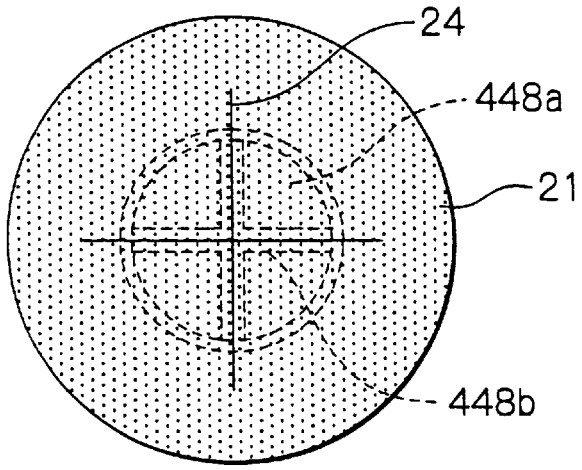
FIG. 20 is a plan view of the seal valve.

FIG. 19 shows the end portion of the nozzle 445 and a specific configuration of the seal valve 21. As shown, the tip 446 of the nozzle 445 has cruciform ribs while the circular seal valve 21 has the previously stated cruciform slits 24. The ribs and slits 24 each intersect each other at the center of a circle. As shown in FIG. 20, when the toner container 20 is mounted to the apparatus body, the tip 46 mates with the slits 24. That is, the slits 24 do not overlap the open portions 448*a* of the toner inlet 448. The seal valve 21 can therefore be smoothly set because the tip 446 is positioned at the slit 24 when the nozzle 445 penetrates into the toner container 20.

If the slits 24 meet the open portions 448*a* of the toner inlet 448, then the toner is apt to drop from the nozzle 445 when the toner container 20 is pulled out, because the slits 24 will be opened. The slits 24 not overlapping the open portions 448*a* obviate such an occurrence. As for the nozzle 345 shown in FIGS. 17 and 18, three slits 24 may be formed in the seal valve 21 at the intervals of 120° in matching relation to the configuration of the tip 346. This also prevents the slits 24 from overlapping the open portions 348*a* of the toner inlet 348.

Figure 21:
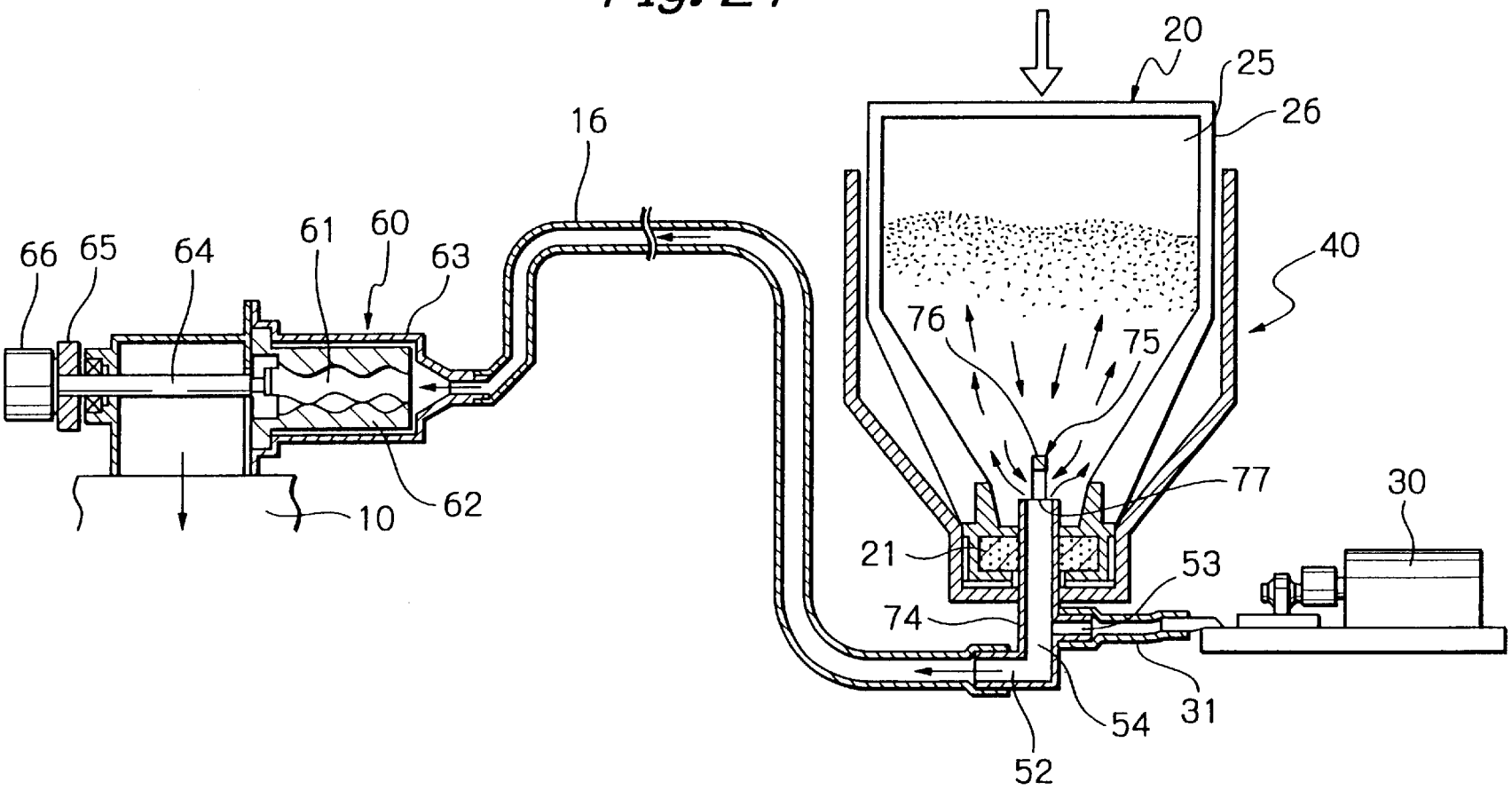
FIG. 21 is a section showing an alternative embodiment of the present invention.

Referring to FIG. 21, an alternative embodiment of the present invention will be described. Briefly, this embodiment includes a suction type powder pump 60 added to the mechanism shown in FIG. 5 and a nozzle 75 having a single tubular wall, as distinguished from the double-wall structure. As shown, the powder pump 60 is provided in the vicinity of or formed integrally with the developing unit 10 and implemented as a single-axis screw pump. The powder pump 60 is made up of a rotor 61, a stator 62, and a holder 63. The rotor 61 is configured as an eccentric screw formed of metal or similar rigid material. The stator 62 is implemented as a double-thread screw formed of rubber or similar elastic material. The holder 63 surrounds the rotor 61 and stator 62 in such a manner as to form a powder conveyance path and is formed of, e.g., resin. The rotor 61 is connected to a drive shaft 64 by a pin joint and caused to rotate via a gear 65, which is mounted on the drive shaft 64. A solenoid-operated clutch 66 controls the operation of the powder pump 60. A suction port 67 is formed at the right end of the holder 63, as viewed in FIG. 21. The tube 16 provides communication between the suction port 67 and a toner outlet 52 formed in the nozzle 75.

The powder pump or screw pump 60 is capable of conveying toner with a high solid-to-air ratio continuously and constantly, i. e., by an accurate amount proportional to the rotation speed of the rotor 61, as well known in the art. A replenishment command, which may be generated as a result of image density sensing, causes the powder pump 60 to operate and replenish a required amount of toner to the developing unit 10.

The toner container 20 is removably set in the setting portion 40 included in the apparatus body, but implemented as a unit independent of the developing unit 10. The nozzle 75 extends upward from the bottom of the setting portion 40. The toner container 20 is inserted into the setting portion 40 from the above.

Figure 22:
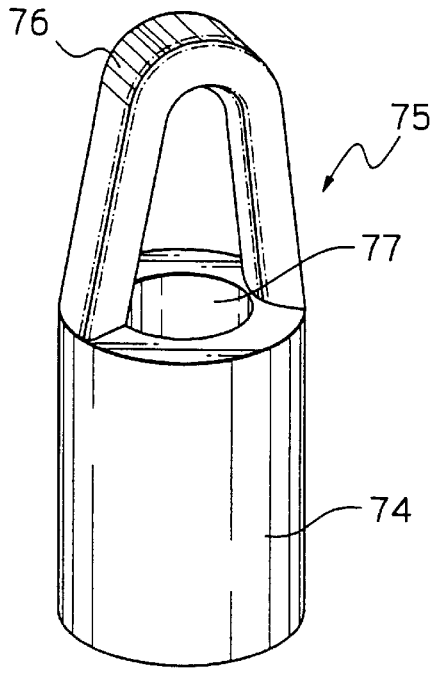
FIG. 22 is an isometric view of a nozzle included in the embodiment of FIG. 21.
Figure 23:
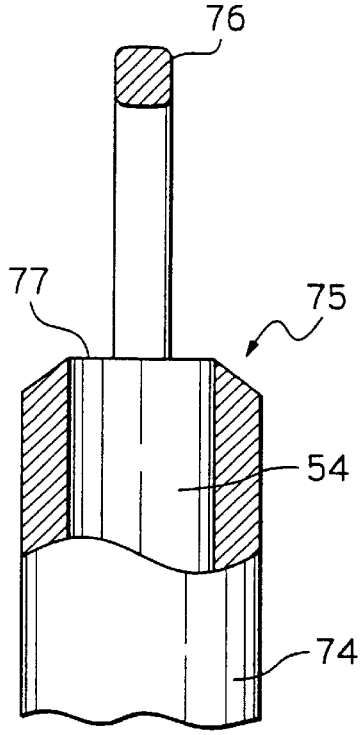
FIG. 23 is a section of the nozzle shown in FIG. 22.
Figure 24A:
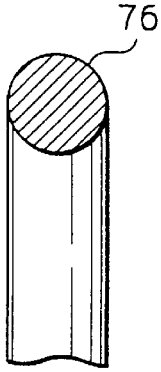
FIGS. 24A, 24B and 24C are sections each showing a specific configuration of a tip included in the alternative embodiment.
Figure 24B:
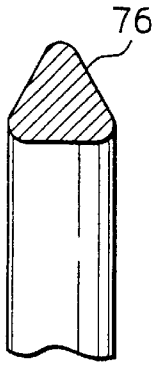
Figure 24C:
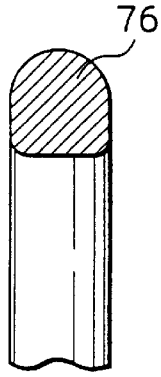

As shown in FIGS. 21 through 23, the nozzle 75 has a single passage 54 playing the role of an air passage for introducing air into a nozzle body 74 and the role of a toner passage at the same time. The toner outlet 52 and an air inlet 53 are contiguous with the passage 54. A tip 76 is formed integrally with or adhered to the end of the nozzle body 74. The tip 76 is implemented by a single shaft bent in an arch configuration and having a substantially square cross-section; the corners of the square are suitably rounded. If desired, the tip 76 may have a circular or oblong cross-section, as shown in FIG. 24A, a triangular cross-section, as shown in FIG. 24B, or a cross section which is circular in the upper portion and rectangular in the lower portion, as shown in FIG. 24C. The cross-section may even be polygonal. Such a rectangular or polygonal cross-section must have their corners rounded. In any case, the tip 76 is free from sharp corners and catches the sponge of the seal valve 21 little despite the fitting and unfitting of the toner container 20. This protects the sponge from tearing.

Further, the nozzle 75 whose tip 76 is implemented by a single shaft is advantageous over the umbrella-like tips 46, 146 and 246 and rib-like tips 346 and 46 in the following respects. The tip 76 scarcely covers an opening 77, at which the passage 54 terminals, compared to the previously stated tips. Because the tip 76 is configured in the form of a letter 1, as seen from the above, it scarcely catches the sponge of the seal valve 21, compared to the other tips. This more surely protects the sponge form tearing; otherwise, the pieces of the sponge torn off would be introduced into the developing unit 10 and disturb an image.

In the above-described toner replenishing device, by raising the air pressure in the toner container 20, it is possible to deliver the toner from the toner container 20 while promoting the agitation and fluidization of the toner. At this instant, the powder pump 60 helps air discharge the toner and surely conveys the toner to the developing unit 10.

As shown in FIG. 21, the toner container 20 has a bag-in-box type configuration made up of a deformable bag 25 storing the toner and a box 26 accommodating the bag 25 and more rigid than the bag 25. Specifically, after the flexible bag 25 has been packed with the toner, the bag 25 is accommodated in the box 26. The toner container 20 is therefore easy to handle. Moreover, after the tone container 20 has been emptied, the back 25 and box 26 can be separated from each other and collected.

Because the passage 54 bifunctions as an air passage and a toner passage, the above toner replenishing mechanism is so controlled as not to send air and replenish the toner at the same time. Specifically, before the replenishment of the toner, the air pump 30 is driven to send air into the toner container 20 in order to fluidize the toner existing therein. Such air supply may not be effected every time the toner is to be replenished, but may be effected only when toner replenishment has been repeated a preselected number of times or when a main switch, not shown, provided on the apparatus body is turned on or even once a day.

Subsequently, the powder pump 60 is caused to replenish the toner to the developing unit 10 via the nozzle 75 by suction. The powder pump or screw pump 60 is capable of conveying toner with a high solid-to-air ratio continuously and constantly, i.e., by an accurate amount proportional to the rotation speed of the rotor 61, as stated earlier. Therefore, the amount of toner to be conveyed can be control led in terms of the duration of drive of the powder pump 60. The mechanism of the powder pump 60 should advantageously be constructed into a unit from the production and maintenance standpoint.

Any conventional circuitry may be used to drive and control the image forming apparatus having the above-described construction.

A conventional permeability sensor, not shown, senses the toner content of the developer. When the toner content decreases below a preselected value, the powder pump 60 is energized to convey the toner from the toner container 20 to the developing unit 10. As soon as the toner content increases to the preselected value, the powder pump 60 is deenergized.

The above-described control allows the developer stored in the developing unit 10 to maintain a preselected toner content at all times and thereby insures stable development. When the permeability sensor senses a short toner content a preselected number of times or over a preselected period of time, it is determined that the toner container 20 is empty. As a result, an alarm message meant for the operator appears on an operation panel or a display, not shown, mounted on the apparatus body, showing the operator an adequate time for replacement. If desired, the permeability sensor may be replaced with a conventional sensor responsive to the density of a toner image formed on the drum.

Toner for use in an electrophotographic image forming apparatus has extremely low fluidity and is difficult to convey, as well known in the art. In accordance with the present invention, toner is conveyed together with air and therefore substantially free from mechanical stresses. This, coupled with the fact that the drive load of the conveying member is zero, allows toner to maintain its property and insures the conveyance of toner, thereby enhancing the reliability and durability of the toner replenishing device. In addition, the toner replenishing device is simple in construction and is low in power consumption and cost because of the low drive load.

Furthermore, the toner replenishing device should only be connected by the developing unit 10 by a flexible tube and prevents tone from flying about. Also, the toner replenishing device can be located at any desired position that facilitates the replacement of the toner container.

Moreover, the developing unit 10 has an extremely simple configuration because a toner storing section is not formed integrally with or positioned in the vicinity of the unit 10. Also, only the developing sleeve and screws of the developing unit 10 should be driven, making the unit 10 small size, simple, low cost and reliable while enhancing power saving and easy maintenance. Of course, the entire image forming apparatus achieves the advantages described above.

While the nozzle should preferably have a circular cross-section, as shown and described, it may alternatively have a polygonal, oblong or track-like cross-section. The present invention is applicable even to a developing unit of the type using a one-ingredient type developer, i.e., toner.

In summary, it will be seen that the present invention has various unprecedented advantages, as enumerated below.

(1) Toner can be surely conveyed from a toner container and remains in the toner container little.

(2) Toner is prevented from entering a toner inlet before it is fluidized by air.

(3) Air flows over a broad range within the toner container and fluidizes toner over such a range to thereby surely deliver the toner from the toner container.

(4) Toner drops little when the toner container is pulled out.

(5) Toner around the toner inlet is sufficiently fluidized and smoothly conveyed.

(6) Air coming out of an air outlet scarcely enters the toner inlet.

(7) A nozzle has a simple configuration and is therefore inexpensive.

(8) The nozzle easily penetrates a seal valve.

(9) The nozzle scarcely catches the seal valve.

(10) The toner container is easy to mount and dismount and realizes stable toner conveyance.

(11) A seal member is prevented from turning up and stopping the toner inlet or the air outlet.

(12) Toner is prevented from leaking via slits formed in the seal member.

(13) An image forming apparatus has a toner replenishing device that allows a minimum of toner to remain in the toner container.

(14) The image forming apparatus allows the toner container to be easily set thereon by hand.

Various modifications will become possible for those skilled in the art after receiving the teachings of the present disclosure without departing from the scope thereof.

What is claimed is:

1. A nozzle having an end portion capable of penetrating into atoner discharging portion of toner storing means that stores powdery toner, said nozzle comprising:

a tubular nozzle body;

an air passage formed in said nozzle body for sending air into said toner storing means; and a toner passage formed in said nozzle body for delivering the toner discharged from said toner storing means.

2. A nozzle as claimed in claim 1, wherein said nozzle body has a tubular double-wall structure in which said toner passage surrounds said air passage.

3. A nozzle as claimed in claim 2, wherein an air outlet and a toner inlet communicated to said air passage and said toner passage, respectively, are formed in an end portion of said nozzle body, said air outlet being closer to said end portion than said toner inlet.

4. A nozzle as claimed in claim 3, wherein said toner inlet is open at the end portion of said nozzle body in a direction in which said end portion extends.

5. A nozzle as claimed in claim 4, wherein said air outlet is formed in a side wall of said nozzle body at a same level as said toner inlet.

6. A nozzle as claimed in claim 5, further comprising a tip located at the end of said nozzle body.

7. A nozzle as claimed in claim 6, wherein said tip comprises a shaft bent in an arch configuration and having opposite ends thereof affixed to an outer periphery of said nozzle body.

8. A nozzle as claimed in claim 7, wherein said shaft has a polygonal cross-section having corners thereof rounded.

9. A nozzle as claimed in claim 8, wherein an end of said tip has an acute angle.

10. A nozzle as claimed in claim 1, wherein an air outlet and a toner inlet communicated to said air passage and said toner passage, respectively, are formed in an end portion of said nozzle body, said air outlet being closer to said end portion than said toner inlet.

11. A nozzle as claimed in claim 10, wherein said toner inlet is open at the end portion of said nozzle body in a direction in which said end portion extends.

12. A nozzle as claimed in claim 11, wherein said air outlet is formed in a side wall of said nozzle body at a same level as said toner inlet.

13. A nozzle as claimed in claim 12, further comprising a tip located at the end of said nozzle body.

14. A nozzle as claimed in claim 13, wherein said tip comprises a shaft bent in an arch configuration and having opposite ends thereof affixed to an outer periphery of said nozzle body.

15. A nozzle as claimed in claim 14, wherein said shaft has a polygonal cross-section having corners thereof rounded.

16. A nozzle as claimed in claim 15, wherein an end of said tip has an acute angle.

17. A nozzle as claimed in claim 11, wherein said air outlet is positioned upstream of said toner inlet in a direction in which said nozzle penetrates into said toner storing means.

18. A nozzle as claimed in claim 17, further comprising a tip located at the end of said nozzle body.

19. A nozzle as claimed in claim 18, wherein said tip comprises a shaft bent in an arch configuration and having opposite ends thereof affixed to an outer periphery of said nozzle body.

20. A nozzle as claimed in claim 19, wherein said shaft has a polygonal cross-section having corners thereof rounded.

21. A nozzle as claimed in claim 20, wherein an end of said tip has an acute angle.

22. A nozzle as claimed in claim 1, wherein said nozzle body has a tubular double-wall structure in which said air passage surrounds said toner passage.

23. A nozzle as claimed in claim 22, wherein an air outlet and a toner inlet communicated said air passage and said toner passage, respectively, are formed in an end portion of said nozzle body, said air outlet being formed in a side wall of said nozzle body.

24. A nozzle as claimed in claim 23, wherein said toner inlet is open at the end portion of said nozzle body in a direction in which said end portion extends.

25. A nozzle as claimed in claim 24, wherein said air outlet is formed in a side wall of said nozzle body at a same level as said toner inlet.

26. A nozzle as claimed in claim 25, further comprising a tip located at the end of said nozzle body.

27. A nozzle as claimed in claim 26, wherein said tip comprises a shaft bent in an arch configuration and having opposite ends thereof affixed to an outer periphery of said nozzle body.

28. A nozzle as claimed in claim 27, wherein said shaft has a polygonal cross-section having corners thereof rounded.

29. A nozzle as claimed in claim 28, wherein an end of said tip has an acute angle.

30. A nozzle as claimed in claim 1, further comprising a tip located at an end of said nozzle body.

31. A nozzle as claimed in claim 30, wherein an end of said tip has an acute angle.

32. A nozzle as claimed in claim 30, wherein said tip comprises a shaft bent in an arch configuration and having opposite ends thereof affixed to an outer periphery of said nozzle body.

33. A nozzle as claimed in claim 32, wherein said shaft has a polygonal cross-section having corners thereof rounded.

34. A nozzle as claimed in claim 33, wherein an end of said tip has an acute angle.

35. A nozzle having an end portion capable of penetrating into a toner discharging portion of toner storing means that stores powdery toner, said nozzle comprising:

a tubular nozzle body; and a passage formed in said nozzle body and constituting both of an air passage for sending air into said toner storing means and a toner passage for delivering the toner discharged from said toner storing means.

36. A nozzle as claimed in claim 35, further comprising a tip located at the end of said nozzle body.

37. A nozzle as claimed in claim 36, wherein an end of said tip has an acute angle.

38. A nozzle as claimed in claim 36, wherein said tip comprises a shaft bent in an arch configuration and having opposite ends thereof affixed to an outer periphery of said nozzle body.

39. A nozzle as claimed in claim 38, wherein said shaft has a polygonal cross-section having corners thereof rounded.

40. A nozzle as claimed in claim 39, wherein an end of said tip has an acute angle.

41. A nozzle as claimed in claim 38, wherein said shaft has a circular cross-section.

42. A nozzle as claimed in claim 41, wherein an end of said tip has an acute angle.

43. In a toner conveying device including a nozzle having an end portion capable of penetrating into a toner discharging portion of toner storing means that stores powdery toner, said nozzle comprising:

a tubular nozzle body;

an air passage formed in said nozzle body for sending air into said toner storing means; and a toner passage formed in said nozzle body for delivering the toner discharged from said toner storing means.

44. A toner conveying device as claimed in claim 43, wherein the toner discharging portion is formed in a bottom of the toner storing means such that said nozzle is capable of penetrating into said toner discharging portion, and wherein a toner inlet formed is formed in said nozzle and enters, when said nozzle is inserted into said toner discharging portion, said toner storing means to a position spaced from a lowest position of said toner storing means by more than a preselected distance.

45. A toner conveying device as claimed in claim 44, further comprising a tip located at an end of said nozzle body and implemented by a shaft that is bent in an arch configuration and has opposite ends thereof affixed to an outer periphery of said nozzle body, and wherein the toner discharging portion of the toner storing means is sealed by sealing means formed with slits that are coincident in position with said shaft in a circumferential direction of said nozzle body.

46. A toner conveying device as claimed in claim 44, wherein the toner discharging portion is formed in a bottom of the toner storing means such that said nozzle is capable of penetrating into said toner discharging portion, and wherein an air inlet is formed in said nozzle and enters, when said nozzle is inserted into said toner discharging portion, said toner storing means to a position spaced from a lowest position of said toner storing means by more than a preselected distance.

47. A toner conveying device as claimed in claim 46, further comprising a tip located at an end of said nozzle body and implemented by a shaft that is bent in an arch configuration and has opposite ends thereof affixed to an outer periphery of said nozzle body, and wherein the toner discharging portion of the toner storing means is sealed by sealing means formed with slits that are coincident in position with said shaft in a circumferential direction of said nozzle body.

48. A toner conveying device as claimed in claim 43, wherein the toner discharging portion is formed in a bottom of the toner storing means such that said nozzle is capable of penetrating into said toner discharging portion, and wherein an air inlet is formed in said nozzle and enters, when said nozzle is inserted into said toner discharging portion, said toner storing means to a position spaced from a lowest position of said toner storing means by more than a preselected distance.

49. A toner conveying device as claimed in claim 48, wherein the toner discharging portion is formed in a bottom of the toner storing means such that said nozzle is capable of penetrating into said toner discharging portion, and wherein an air inlet is formed in said nozzle and enters, when said nozzle is inserted into said toner discharging portion, said toner storing means to a position spaced from a lowest position of said toner storing means by more than a preselected distance.

50. In an image forming apparatus including a toner conveying device including a nozzle having an end portion capable of penetrating into a toner discharging portion of toner storing means that stores powdery toner, said nozzle comprising:

a tubular nozzle body;

an air passage formed in said nozzle body for sending air into said toner storing means; and a toner passage formed in said nozzle body for delivering the toner discharged from said toner storing means.

51. In an image forming apparatus including a nozzle having an end portion capable of penetrating into a toner discharging portion of toner storing means that stores powdery toner, said nozzle comprising:

a tubular nozzle body;

an air passage formed in said nozzle body for sending air into said toner storing means; and a toner passage formed in said nozzle body for delivering the toner discharged from said toner storing means.

52. In an image forming apparatus capable of conveying toner stored in toner storing means to a developing unit with a toner conveying device for thereby replenishing said toner, an end portion of a nozzle being capable of penetrating into a toner discharging portion of said toner storing means, said nozzle comprising:

a tubular nozzle body;

an air passage formed in said nozzle body for sending air into said toner storing means; and a toner passage formed in said nozzle body for delivering the toner discharged from said toner storing means.

53. An image forming apparatus as claimed in claim 52, wherein said nozzle is mounted on a body of said image forming apparatus and penetrates into the toner storing means when said toner storing means is mounted to said body.

* * * * *